US011124351B2

(12) United States Patent
Leung

(10) Patent No.: US 11,124,351 B2
(45) Date of Patent: Sep. 21, 2021

(54) INSULATED DISPOSABLE PAPER-BASED CUPS, LIDS AND CONTAINERS

(71) Applicant: Alan Leung, Toronto (CA)

(72) Inventor: Alan Leung, Toronto (CA)

( * ) Notice: Subject to any disclaimer, the term of this patent is extended or adjusted under 35 U.S.C. 154(b) by 56 days.

(21) Appl. No.: 16/139,417

(22) Filed: Sep. 24, 2018

(65) Prior Publication Data

US 2019/0322439 A1 Oct. 24, 2019

(30) Foreign Application Priority Data

Apr. 24, 2018 (CA) ..... 3002448

(51) Int. Cl.

| | |
|---|---|
| ***B65D 81/38*** | (2006.01) |
| ***A47G 19/03*** | (2006.01) |
| *A47G 19/22* | (2006.01) |
| *B65D 1/48* | (2006.01) |
| *B65D 25/14* | (2006.01) |
| *B65D 43/16* | (2006.01) |

(52) U.S. Cl.

CPC ..... *B65D 81/3811* (2013.01); *A47G 19/03* (2013.01); *A47G 19/2288* (2013.01); *B65D 1/48* (2013.01); *B65D 25/14* (2013.01); *B65D 43/16* (2013.01)

(58) Field of Classification Search

CPC .... B65D 81/3811; B65D 1/265; B65D 25/14; B65D 2251/0093

USPC ..... 220/592.2

See application file for complete search history.

(56) References Cited

U.S. PATENT DOCUMENTS

| | | | | |
|---|---|---|---|---|
| 2,652,971 A | | 9/1953 | Mcfarland et al. | |
| 2,853,222 A | | 9/1958 | Gallagher | |
| RE25,618 E | * | 7/1964 | Goodman | B65D 1/265 220/592.17 |
| 3,870,220 A | | 3/1975 | Koury et al. | |
| 4,061,782 A | | 12/1977 | Baxter | |

(Continued)

FOREIGN PATENT DOCUMENTS

| | | |
|---|---|---|
| CA | 3002448 C | 2/2020 |
| DE | 4023602 A1 | 1/1992 |

(Continued)

OTHER PUBLICATIONS

"Aluminum Foil Paper Cup" product search, website, Focus Technology Co., Ltd., China, 2018. <https://m.made-in-china.com/hot-china-products/Aluminum_Foil_Paper_Cup.html> (14 pages).

(Continued)

*Primary Examiner* — Shawn M Braden

(74) *Attorney, Agent, or Firm* — Bereskin & Parr LLP/S.E.N.C.R.L., s.r.l.; Tony Orsi

(57) ABSTRACT

Various recyclable containers are described herein and generally comprise a frame made of a first paper-based material having a bottom wall and side walls that extend from the bottom wall; and a metallic layer that is removably positioned along an inner surface of the bottom and side walls of the frame; and at least one tab that is attached to a portion of the metallic layer. The at least one tab has a portion that extends past at least one sidewall of the container so that, during recycling, the at least one tab is pulled to remove the metallic layer from the frame. Examples of methods for manufacturing and recycling these containers are also described herein.

23 Claims, 8 Drawing Sheets

(56) References Cited

U.S. PATENT DOCUMENTS

| | | | | |
|---|---|---|---|---|
| 4,697,719 | A * | 10/1987 | Allen | B65D 43/0212 215/232 |
| 5,460,323 | A | 10/1995 | Titus | |
| 6,739,500 | B1 * | 5/2004 | Gentile | B65D 15/06 206/524.8 |
| 8,701,914 | B1 * | 4/2014 | Buck | B65D 3/22 220/23.87 |
| 10,493,735 | B2 * | 12/2019 | Ding | B32B 29/005 |
| 2009/0107861 | A1 | 4/2009 | Crabtree | |
| 2011/0180552 | A1 * | 7/2011 | Sarson | B65D 21/0233 220/592.16 |
| 2014/0183198 | A1 * | 7/2014 | Slack | B31B 50/74 220/495.01 |

FOREIGN PATENT DOCUMENTS

| | | | |
|---|---|---|---|
| DE | 4303216 | A1 | 8/1994 |
| KR | 10-2004-0070466 | A | 8/2004 |
| WO | 2006129066 | A2 | 12/2006 |
| WO | 2013008025 | A2 | 1/2013 |

OTHER PUBLICATIONS

Masengere, "Design for manufacture and assembly of a paper cup making machine in a developing nation", Proceedings of the International Conference on Industrial Engineering and Operations Management, Bandung, Indonesia, Mar. 6-8, 2018, IEOM Society International, pp. 1908-1922.

Office Action issued in corresponding Canadian application No. 3,002,448, dated Apr. 29, 2019, 6 pages.

Office Action issued in corresponding Canadian application No. 3,002,448, dated Jan. 31, 2019, 6 pages.

Office Action issued in corresponding Swedish application No. 1800180-0, dated Oct. 30, 2019, 6 pages.

* cited by examiner

INSULATED DISPOSABLE PAPER-BASED CUPS, LIDS AND CONTAINERS

CROSS-REFERENCE

This application claims the benefit of Canadian Patent Application No. 3,002,448, filed Apr. 24, 2018, and the entire contents of Canadian Patent Application No. 3,002,448 are hereby incorporated by reference.

FIELD

Various embodiments are described herein that generally relate to paper-based cups, lids and containers, such as those used for take-out or otherwise temporary use, having a metallic layer, that are more easily recyclable and environmentally friendly.

BACKGROUND

In our present day of year 2018, people consume drinks and foods in one-time use containers such as coffee cups, soup bowls and take-out food containers that are either partially recyclable or not at all recyclable. While they are convenient to use, such containers and lids cannot be recycled, although they are collected and labeled as recyclable. For example, current cups have a wax or plastic layer (i.e. polyethylene) on an inner and/or outer surface, to keep contents of the cup warm and prevent structural breakdown of the cup, but the wax layer causes contamination to the paper and thus millions upon millions of paper cups, which were thought by the general public as being recyclable, are in fact, not recyclable. The cup lid poses a problem as well, as it is made of plastic, since not all types of plastics can be recycled.

Similarly, single-use temporary containers, such as "take out" containers, that are made of non-recyclable plastic cannot be recycled. Also, when such containers are made with black plastic bottoms and/or have black plastic lids, such containers are non-recyclable. Black containers are not recyclable because the colour of the black plastic elements causes problems for existing conveyor belts at recycling plants since such conveyor belts cannot distinguish between these materials, due to the black coloured elements, and therefore cannot recycle such containers.

In addition, the plastic or wax used in current cups and containers may be difficult to remove from the paper used to make these various containers due to bonding that has occurred and, if these materials are recyclable they require very particular recycling techniques which may be more expensive and therefore not readily available. Accordingly, recycling plants may reject these disposed containers which may then be sent to a landfill. Furthermore, the plastic or wax layer may take degrades over a very long time (i.e. years), which is not good for the environment.

SUMMARY OF VARIOUS EMBODIMENTS

In one broad aspect, in accordance with the teachings herein, there is disclosed a recyclable container comprising: a frame made of a first paper-based material, the frame having a bottom wall and side walls that extend from the bottom wall; and a metallic layer that is removably positioned along an inner surface of the bottom and side walls of the frame; and at least one tab that is attached to a portion of the metallic layer, the at least one tab having a portion that extends past at least one sidewall of the container, wherein, during recycling, the at least one tab is pulled to remove the metallic layer from the frame.

In at least one embodiment, the frame and the metallic layer each have an upper wall extending to each side wall.

In at least one embodiment, an opening is formed by pulling the at least one tab or an opening is formed by pulling the at least one tab and removing an end portion of the at least one tab.

In at least one embodiment, the metallic layer includes a strip with at least one grip portion and the at least one grip is pulled to remove the metallic layer from the paper-based frame.

In at least one embodiment, the at least one tab extends past an opening of the container and overlaps an outer surface of the outer frame.

In at least one embodiment, the container comprises a lid having: a body made of a second paper-based material; a second metallic layer on an inner surface of the body; and at least one groove that is sized and shaped to mate with an upper edge of at least one side wall at an opening of the frame.

In at least one embodiment, the container is a cup, a bowl, or a take-out container and the lid is integral with or separate from the frame of the container.

In at least one embodiment, the metallic layer has an outer surface that is sized to provide a friction fit when the metallic layer is disposed within the frame to maintain the metallic layer in place during use.

In at least one embodiment, the metallic layer comprises at least one rib on an outer surface thereof and the frame comprises at least one groove on an inner surface thereof, the at least one rib and the at least one groove being located and sized to removably engage one another when the metallic layer is disposed within the frame to maintain the metallic layer in place during use.

In at least one embodiment, the metallic layer comprises at least one groove on an outer surface thereof and the frame comprises at least one rib on an inner surface thereof, the at least one groove and the at least one rib being located and sized to removably engage one another when the metallic layer is disposed within the frame to maintain the metallic layer in place during use.

In at least one embodiment, a bonding agent is applied to one or more corresponding portions of the outer surface of the metallic layer and the inner surface of the frame to hold the metallic layer in place during use, wherein the bonding agent is temporary and is removable during recycling.

In at least one embodiment, the bonding agent comprises a natural glue.

In at least one embodiment, the frame and/or the lid comprises at least one layer of paper.

In at least one embodiment, the frame comprises an outer layer that is corrugated paper with horizontal and/or vertical ribs.

In at least one embodiment, the frame comprises a middle layer that is corrugated paper with horizontal and/or vertical ribs and an outer paper layer with a relatively flat external surface.

In at least one embodiment, the first and second paper-based materials comprise at least one of recycled paper, fibrous pulp and a fibrous material blend.

In at least one embodiment, the metallic layer comprises at least one of aluminum foil, aluminum alloy, anodized aluminum, nickel and tin.

In another broad aspect, in accordance with the teachings herein, there is disclosed a method of making a container having an inner metallic layer, wherein the method comprises: forming a paper-based frame having a desired shape; forming a first metallic layer being sized to provide an inner lining for the paper-based frame; and releasably coupling the first metallic layer to an inner surface of the paper-based frame.

In at least one embodiment, the first metallic layer has a complementary shape as the paper-based frame to provide a friction fit when placed within the paper-based frame.

In at least one embodiment, the method further comprises providing at least one tab adjacent to an outer edge of the first metallic layer.

In at least one embodiment, an outer portion of the at least one tab is wrapped to a portion of the paper-based frame to releasably couple the first metallic layer to the paper-based frame.

In at least one embodiment, the method further comprises: forming a lid with a paper-based body; forming a second metallic layer sized to provide an inner lining for the paper-based body; and releasably coupling the second metallic layer to a surface of the lid that faces towards an opening of the container when the lid is placed on the frame of the container.

In at least one embodiment, the method further comprises providing at least one additional tab adjacent to an outer edge of the second metallic layer; and wrapping an outer portion of the at least one additional tab to a portion of the paper-based body to couple the second metallic layer to the paper-based body.

In another broad aspect, in accordance with the teachings herein, there is disclosed a method of recycling a container having a paper-based body and a releasably couplable an inner metallic layer, wherein the method comprises: obtaining the container; separating the metallic layer from the paper-based body; and placing the metallic layer and the paper-based body in different containers.

In at least one embodiment, the metallic layer includes at least one tab and the method comprises pulling the at least one tab to separate the metallic layer from the paper-based body.

In at least one embodiment, the separating comprises placing the container in a vat containing a liquid bath, allowing the metallic layer to rise to the surface of the liquid bath and the paper-based frame to sink below the surface of the liquid bath.

In at least one embodiment, the method comprises collecting the metallic layer from the surface of the liquid bath, and collecting the paper-based frame from the bottom of the vat.

Other features and advantages of the present application will become apparent from the following detailed description taken together with the accompanying drawings. However, it should be understood that the detailed description and the specific examples, while indicating preferred embodiments of the application, are given by way of illustration only, since various changes and modifications within the spirit and scope of the application will become apparent to those skilled in the art from this detailed description.

BRIEF DESCRIPTION OF THE DRAWINGS

For a better understanding of the various embodiments described herein, and to show more clearly how these various embodiments may be carried into effect, reference will be made, by way of example, to the accompanying drawings which show at least one example embodiment, and which are now described. The drawings are not intended to limit the scope of the teachings described herein.

Figure 1A:
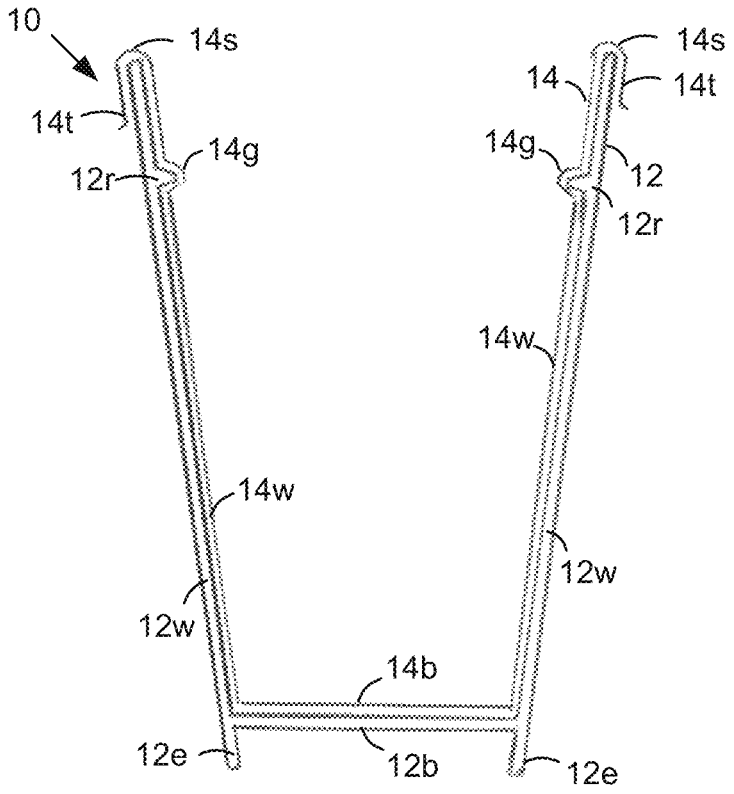
FIG. 1A is a cross-sectional side view of an example embodiment of a paper-based cup with an inner metallic layer in accordance with the teachings herein.

Further aspects and features of the example embodiments described herein will appear from the following description taken together with the accompanying drawings.

DETAILED DESCRIPTION OF THE EMBODIMENTS

Various embodiments in accordance with the teachings herein will be described below to provide an example of at least one embodiment of the claimed subject matter. No embodiment described herein limits any claimed subject matter. The claimed subject matter is not limited to devices, systems or methods having all of the features of any one of the devices, systems or methods described below or to features common to multiple or all of the devices, systems or methods described herein. It is possible that there may be a device, system or method described herein that is not an embodiment of any claimed subject matter. Any subject matter that is described herein that is not claimed in this document may be the subject matter of another protective instrument, for example, a continuing patent application, and the applicants, inventors or owners do not intend to abandon, disclaim or dedicate to the public any such subject matter by its disclosure in this document.

It will be appreciated that for simplicity and clarity of illustration, where considered appropriate, reference numerals may be repeated among the figures to indicate corresponding or analogous elements or steps. In addition, numerous specific details are set forth in order to provide a thorough understanding of the example embodiments described herein. However, it will be understood by those of ordinary skill in the art that the embodiments described herein may be practiced without these specific details. In other instances, well-known methods, procedures and components have not been described in detail so as not to obscure the embodiments described herein. Also, the description is not to be considered as limiting the scope of the example embodiments described herein.

Unless the context requires otherwise, throughout the specification and claims which follow, the word "comprise" and variations thereof, such as, "comprises" and "comprising" are to be construed in an open, inclusive sense, that is, as "including, but not limited to".

It should also be noted that, as used herein, the wording "and/or" is intended to represent an inclusive-or. That is, "X and/or Y" is intended to mean X or Y or both, for example. As a further example, "X, Y, and/or Z" is intended to mean X or Y or Z or any combination thereof.

It should be noted that terms of degree such as "substantially", "about" and "approximately" as used herein mean a reasonable amount of deviation of the modified term such that the end result is not significantly changed. These terms of degree may also be construed as including a deviation of the modified term, such as by 1%, 2%, 5% or 10%, for example, if this deviation does not negate the meaning of the term it modifies.

Furthermore, the recitation of any numerical ranges by endpoints herein includes all numbers and fractions subsumed within that range (e.g. 1 to 5 includes 1, 1.5, 2, 2.75, 3, 3.90, 4, and 5). It is also to be understood that all numbers and fractions thereof are presumed to be modified by the term "about" which means a variation of up to a certain amount of the number to which reference is being made if the end result is not significantly changed, such as 1%, 2%, 5%, or 10%, for example.

Reference throughout this specification to "one embodiment", "an embodiment", "at least one embodiment" or "some embodiments" means that one or more particular features, structures, or characteristics may be combined in any suitable manner in one or more embodiments, unless otherwise specified to be not combinable or to be alternative options.

As used in this specification and the appended claims, the singular forms "a," "an," and "the" include plural referents unless the content clearly dictates otherwise. It should also be noted that the term "or" is generally employed in its broadest sense, that is, as meaning "and/or" unless the content clearly dictates otherwise.

The headings and Abstract of the Disclosure provided herein are for convenience only and do not interpret the scope or meaning of the embodiments.

The various embodiments of recyclable containers described herein may use raw materials in their purest form or natural state, so that the recycling process and ultimately the re-use of the raw materials will save on recycling plant costs as well as cost savings for reducing the need for new raw material since previously used raw materials can be recycled. Accordingly, such containers, in addition to public recycling awareness programs and incentives (such as perhaps a cash return policy as used for beer and wine bottles), will be beneficial to the environment.

It should be understood that the term "container" covers frames that are in the shape of disposable cups, bowls, containers (e.g. take-out containers), party platter take out trays, and/or individual hamburger or French fry containers of various sizes as well as lids for these frames where the lids can be integral with or separate from but removably attachable to the frames of these containers. For example, in the various embodiments described herein, the cups may be coffee cups, juice cups, tea cups, espresso cups or other types of beverage cups, the bowls may be soup bowls, salad bowls or other types of bowls and the containers may be take-out containers, juice cartons, milk cartons or other types of containers containing other beverages, milk, cream, sugar, salt, stock, coffee, syrups, molasses, flour, corn starch, seeds, grains, dog food and cat food (either dry or moist). The various container embodiments described herein will keep liquid contents air tight and sealed within the metallic lining. For dry contents, the various container embodiments described herein will keep contents free of moisture and will be air-tight.

The various embodiments of the recyclable containers described herein are generally made using a combination of paper and a metallic layer (i.e. a sheet of metal) such as, but not limited to, aluminum foil of an appropriate grade, aluminum alloy, anodized aluminum, nickel and tin. The metallic layer can be used to waterproof the container and thereby protect the structural integrity of the container when it holds liquid or hot materials.

In another aspect, in accordance with the teachings herein, one or more techniques are provided to manufacture the containers described herein.

In another aspect, in accordance with the teachings herein, one or more techniques are provided to recycle the containers described herein.

In the container embodiments described herein, the paper material that is used to form the containers and lids may be, but are not limited to, one or more of recycled paper, any appropriate fibrous material, such as fibrous pulp or a type of fibrous material blend, for example. For example, the fibrous material may be pulp from trees. However, since trees take many years to grow to a harvestable size, the fibrous material may be obtained from other, faster growing plants as these may be able to provide a greater supply for manufacturing the containers described herein. For example, the fibrous material may include one or more of organic matter such as hay, grasses, wheat stalks, cornhusks, bamboo and fallen autumn leaves of deciduous trees. In some embodiments, the paper material that is used to form a container, in accordance with the teachings herein, may be one or more sheets or a thick layer of the paper materials described herein. The paper-based material may be referred to as a paper substrate.

The metallic layer that is used with the containers described herein is fully removable and can be held in place during use by various techniques which are reversible thereby allowing for easy separation of the metallic and paper materials which improves ease of recycling. For example, the metallic layer can be an exact fit to the container within which it is used, thereby allowing the metallic layer to be held in place by a compression or friction fit.

Alternatively, in some embodiments, the metallic layer can be held in place using a raised male/female rib/groove connection between certain regions of the metallic layer and corresponding opposing regions of the paper-based frame of the container.

In another alternative, some embodiments may have a combination of a friction fit and one or more raised male/female rib/groove connections may be used to hold the metallic paper in place during use.

In another alternative, any of the aforementioned embodiments may also incorporate clips or tabs that are positioned at an upper edge of the metallic layers, and have an overlap portion that overlap a lip of an upper edge of the paper-based frame at an opening of the container. The overlap portion can be crimped or otherwise depressed to provide compression at the upper edge of the paper-based frame at the opening of the container to hold the metallic layer in place. The overlap portion may be made of the same material as the metallic layer or it can be made of a different material and bonded to the metallic layer. In some embodiments, the upper edge of the paper-based frame may provide a flange or lip about which the overlap portion of the metallic layer is wrapped to further maintain the metallic layer in place during use.

In another alternative, any of the aforementioned embodiments may also incorporate a bonding agent on one or more opposing portions of the paper substrate and the metallic layer to further ensure that the metallic layer is held in place during use. For example, if needed, a small dab of natural glue along certain portions on the bottom surface of the metallic layer may be used to adhere to the paper-based frame. In such embodiments, the bonding agent may be made from a natural material such as, but not limited to, a natural glue, or sap from coniferous trees, for example. In the case of natural glue, it may be made by combining various natural ingredients such as gelatin, vinegar and sugar. The natural glue may partially melt into the paper as the hot content of the container slowly activates the melting process. Alternatively, the bonding agent may be made from a suitable material that is non-toxic and can be developed by a chemist.

It should be noted that in the various embodiments described herein, all ingredients may preferably be made from non-toxic natural substances.

Figure 1B:
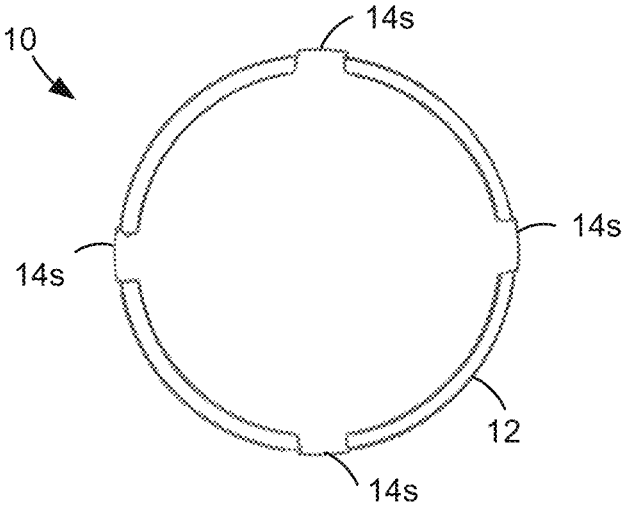
FIG. 1B is a top view of the paper-based cup of FIG. 1A.

Referring now to FIGS. 1A and 1B, shown therein is a cross-sectional side view and a top view, respectively, of an example embodiment of a recyclable container 10, which is in the form or a paper-based cup 10 with an inner metallic layer 14 in accordance with the teachings herein. The container 10 comprises a frame 12 made of a first paper-based material, which may be made from one or more of the paper materials described herein. The frame 12 has a bottom wall 12*b* and side walls 12*w* that extend from the bottom wall 12*b*. The container 10 also includes the metallic layer 14 that is removably positioned along an inner surface of the bottom wall 14*b* and side walls 14*w* of the frame 12. The metallic layer 14 is separate element that is removably attached to the paper-based frame 12 using various techniques described herein. The metallic layer 14 may be made from one or more of the metallic materials described herein.

In this example embodiment, there is also at least one tab 14*t* that is attached to a portion of the metallic layer 14 near an opening of the container 10. The at least one tab 14*t* has an overlap portion 14*s* that extends past the opening of the container 10 and overlaps an outer surface of the frame 12 near the opening of the container 10. There may be a different number of tabs 14*t* that may be used. For example, one tab 14*t* may be used in some embodiments. Alternatively, two tabs 14*t*, three tabs 14*t* or more may be used and may be equally spaced about the circumference of the opening of the container 10. For instance, as shown in FIG. 1B, there may be four overlap portions 14*s* from four tabs 14*t* that are equally spaced about the opening of the container 10.

As will be described in further detail below, during recycling, the at least one tab 14*t* may be pulled away from the frame 12 to remove the metallic layer 14 from the frame 12. This may be done using machinery at a recycling plant. Alternatively, a user of the container may do this manually when they are disposing of the container.

In this example embodiment, the frame 12 further comprises an extension 12*e* for the bottom wall 12*b* so that the bottom wall 12*b* is raised above a surface, such as a table, upon which the container 10 is placed. The extension 12*e* is a circular ring. The extension 12*e* is optional.

In this example embodiment, the metallic layer 14 comprises at least one groove 14*g* on an outer surface thereof and the frame 12 comprises at least one rib 12*r* on an inner surface thereof. The at least one groove 14*g* and the at least one rib 12*r* are located and sized to oppose one another and removably mate or engage one another when the metallic layer 14 is disposed within the frame 12 to maintain the metallic layer 14 in place during use.

There may be one rib 12*r* and one groove 14*g* that extend along the entire circumference (or perimeter for embodiments where the container is non-circular such as square, rectangular or polygonal) of the of the frame 12 and the metallic layer 14, respectively, Alternatively, there may be two or more ribs 12*r* and two or more grooves 14*g* that extend along certain corresponding (i.e. opposing) portions of the frame 12 and the metallic layer 14 and removably mate or engage with one another.

Alternatively, in other embodiments, the position of the grooves and ribs may be reversed. For example, the metallic layer may comprise at least one rib on an outer surface thereof and the frame comprises at least one groove on an inner surface thereof. The at least one rib and the at least one groove are located and sized to removably mate or engage one another when the metallic layer is disposed within the frame to maintain the metallic layer in place during use.

For such embodiments in which the position of the grooves and ribs are reversed, there may be one rib and one corresponding groove that extend along the circumference (or perimeter as explained earlier for non-circular containers) of the metallic layer and frame, respectively, and removably mate with one another when the metallic layer is placed within the frame. Alternatively, for such embodiments, there may be two or more ribs and two or more grooves that extend along certain corresponding portions of the metallic layer and the frame and removably mate with one another when the metallic layer is placed within the frame.

It should be noted that in some embodiments, in addition to the use of ribs and grooves to hold the metallic layer 14 in place within the frame 12, the metallic layer 14 may also have an outer surface that is sized to provide a friction fit when the metallic layer 14 is disposed within the frame 12 to maintain the metallic layer in place during use.

Figure 1C:
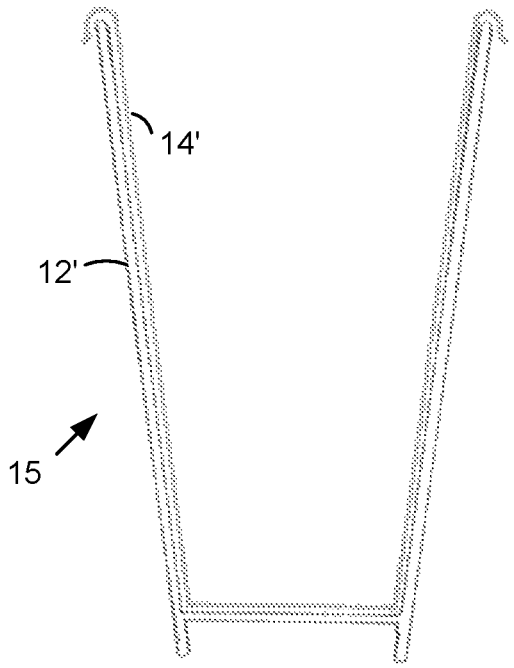
FIG. 1C is a cross-sectional side view of another example embodiment of a paper-based cup with an inner metallic layer in accordance with the teachings herein.

Referring now to FIG. 1C, shown therein is a cross-sectional side view of another example embodiment of a paper-based cup 15 with a frame 12' and an inner metallic layer 14' in accordance with the teachings herein. In this example embodiment, the frame 12' has a relatively flat inner surface and does not include any ribs and the metallic layer 14 has a relatively flat outer surface and does not include any grooves. Accordingly, in this example embodiment, the metallic layer 14' has an outer surface that is sized to provide a friction fit when the metallic layer 14' is disposed within the frame 12' to maintain the metallic layer 14' in place during use.

In other embodiments, as mentioned previously, a bonding agent may also be used in addition to the friction fit, or in addition to the friction fit and the tabs 14*t* or in addition to the friction fit, the tabs 14*t* and the ribs and grooves to retain the metallic layer 14 in place during use. In such embodiments, the bonding agent is applied to certain corresponding portions of outer surface of the metallic layer 14 and inner surface of the frame 12 to hold the metallic layer in place during use. For example, the corresponding portions may be one or more of a portion of the bottom walls 12*b* and 14*b*, corresponding portions of the walls 12*w* and 14*w*, and corresponding portions of the shoulder 14*s* and the upper edge of the frame 12. The term "corresponding portion" means certain surfaces of the frame 12 and the metallic layer 14 that are opposed and adjacent to one another when the metallic layer 14 is located at the inner surface of the frame 12. The amount of bonding material is such that the metallic layer 14 is removably attachable to the frame 12 so that the metallic layer 14 is kept in place during use but the metallic layer 14 can also be relatively easily removed during recycling. In this sense the bonding agent is temporary and is removable (i.e. degradable or breakable) during recycling.

Figure 1D:
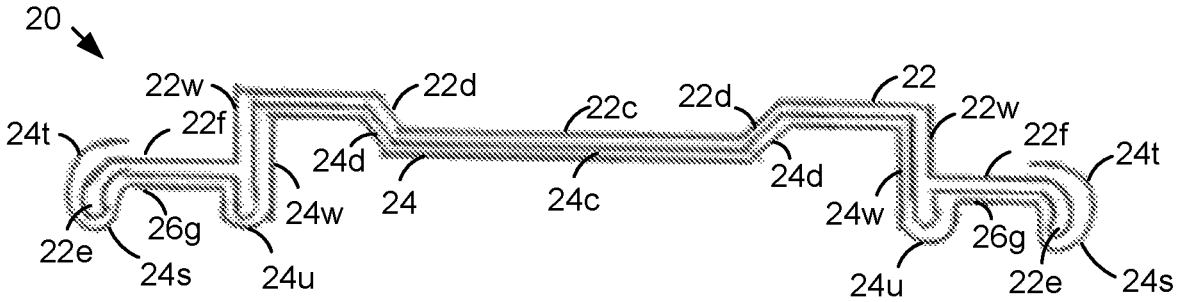
FIG. 1D is a cross-sectional side view of an example embodiment of a lid having a metallic layer that can be used with the cups of FIGS. 1A-1C and 2A-2C.

Referring now to FIG. 1D, shown therein is a cross-sectional side view of an example embodiment of a lid 20 having a paper-based body 22 and a metallic 24 layer. The lid 20 can be used with the containers 10, 15, 50 or 55 shown in FIGS. 1A-1C and 2A-2C. The metallic layer 24 is located on an inner surface of the body 22 of the lid 20. The metallic layer 24 is a separate element that is attached to the paper-based body using various techniques described herein. The lid 20 also has at least one groove 26*g* that is sized and shaped to removably mate with an upper edge of at least one side wall at an opening of the frame of the container 10, 15, 50 or 55.

In this example embodiment, the body 22 comprises a central portion 22*c* that radially extends to a circular wall 22*w*. The body 22 further comprises a flange portion 22*f* that radially extends from a lower portion of the circular wall 22*w* and terminates in a hooked or curved end 22*e*. In some embodiments, as in the example embodiment shown in FIG. 1D, the central portion 22*c* may angle upwards along a radial disk portion 22*d* as it extends radially outward to the wall 22*w* such that an outer circular disc area of the body 22 is at a raised height compared to the central portion 22*c*.

The metallic layer 24 comprises a central portion 24*c* that radially extends to a circular wall 24*w*. The metallic layer 24 further comprises a curved portion 24*u* that extends from a lower portion of the circular wall 24*w*. In some embodiments, the curved portion 24*u* can extend and overlap the bottom surface of wall 22*w* of the body 22 and then terminate. In other embodiments, as is shown in FIG. 1D, the curved portion 24*u* can extend further into tabs 24*t* which overlap the hooked or curved end 22*e* of the body 22 and is shaped similarly to the groove 26*g*. In some embodiments, as in the example embodiment shown in FIG. 1D, the central portion 24*c* may angle upwards along a radial disk portion 24*d* as it extends to the wall 24*w* such that an outer circular disc area of the metallic layer 24 is at a raised height compared to the central portion 24*c*.

Accordingly, as can be seen in FIG. 1D, the body 22 and the metallic layer 24 generally have complimentary shapes such that there is a friction between these two elements to maintain the metallic layer 24 in place during use.

In addition, as shown in this embodiment, the metallic layer 24 can also include optional tabs 24*t* with a shoulder portion 24*s* that overlaps the hooked end portion 22*e* of the body and can be crimped or squeezed to further retain the metallic layer 24 in place during use. In some embodiments, the curved portion 24*u* ends of the metallic layer may just extend and overlap around the bottom surface of the walls 22*w* and can be crimped or squeezed to hold the metallic layer 24 in place during use.

Figure 1E:
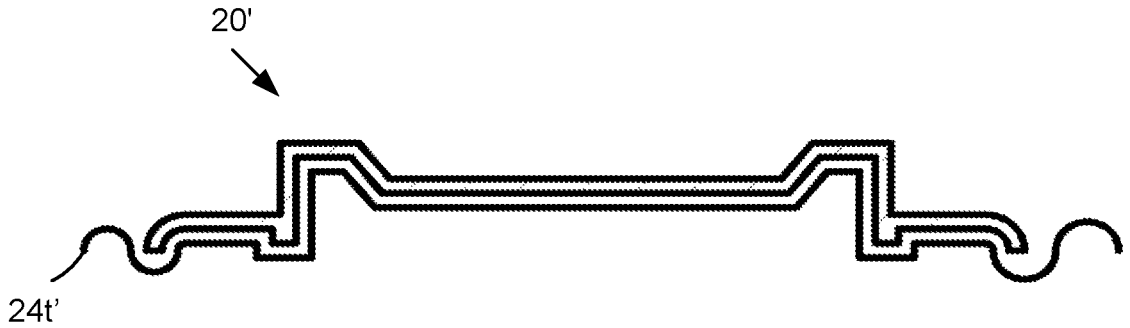
FIG. 1E is a cross-sectional side view of an example of an alternative embodiment of a lid having a metallic layer that can be used with the cups of FIGS. 1A-1C and 2A-2C.

Referring now to FIG. 1E, shown therein is a cross-sectional side view of an example of an alternative embodiment of a lid 20' that has a paper-based body and a metallic layer. In this case the lid 20' has a tab 24*t'* with a different shape in that it has a curved end that curves away from the midline of the lid 20' whereas the tab 24*t* has a curved end that curves towards the midline of the lid 20. The tab 24*t'* may be easier to grip to remove the metallic layer from the paper-based body of the lid 20'.

In other embodiments, a bonding agent may also be used in addition to the friction fit, or in addition to the friction fit and the tabs 24*t* to retain the metallic layer 24 in place during use. In such embodiments, the bonding agent is applied to certain corresponding portions of the body 22 and the metallic layer 24 such as one or more of corresponding portions of the central regions 22*c* and 24*c*, corresponding portions of the walls 22*w* and 24*w*, corresponding portions of the flange 22*f* and the metallic layer 24 that together form the groove 26*g*, and corresponding portions of the end portion 22*e* of the body 22 and the tab 24*t* of the metallic layer 24. The term "corresponding portion" means certain surfaces of the body 22 and the metallic layer 24 that are opposed and adjacent to one another when the metallic layer 24 is located at the inner surface of the body 22. The amount of bonding material is such that the metallic layer 24 is removably attachable to the body 22 so that the metallic layer 24 is kept in place during use but the metallic layer 24 can also be relatively easily removed during recycling. The bonding agent used for the lid 20 may be the same bonding agent that is used between the metallic layers 14, 14' and frames 12, 12' and 52' for containers 10, 15, 50 or 55 or it can be a different bonding agent.

The body 22 is made of a second paper-based material that can be one of the paper materials described herein. The body 22 can be made from the same paper material as the container that the lid 20 is used with or the body 22 can be made from a different paper material. Likewise, the metallic layer 24 can be made from the same material as the metallic layer 14 of the container that the lid 20 is used with or the metallic layer 24 can be made from a different metallic material.

Alternatively, in some embodiments the paper material that is used to form a disposable cup, bowl or container, in accordance with the teachings herein, may include corrugated paper or ribbed paper having vertical, horizontal and/or angled ribs with cavities (known as a "corrugated cavities") such as that which is used for cardboard boxes, for example. The corrugated cavities provide insulating properties for the cup or container that will function to reduce the rate that the contents of the cup or container change temperature as well as to protect the user's hands when the cup or container holds hot contents such as coffee, tea, soups and the like. Furthermore, in some embodiments, the amount of insulation provided by the corrugation may be sufficient such that there is no more need for paper coffee cup sleeves. For instance, example embodiments of cups 50 and 55 shown in FIGS. 2A-2C and "take-out" container 120 use corrugated paper.

Figure 2A:
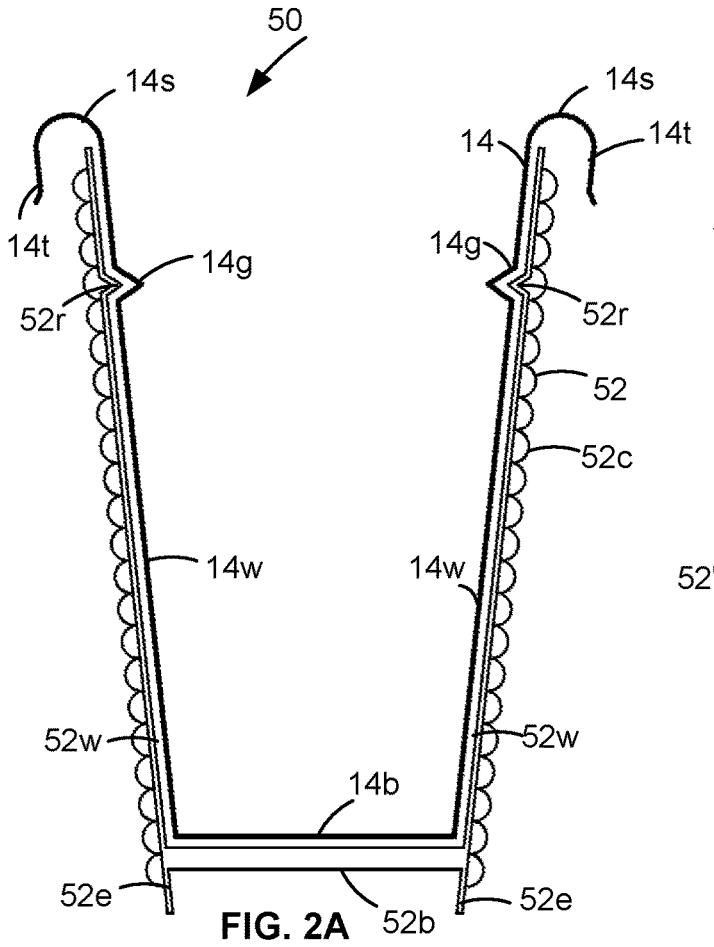
FIG. 2A is a cross-sectional side view of another example embodiment of a paper-based cup with a metallic layer in accordance with the teachings herein.
Figure 2C:
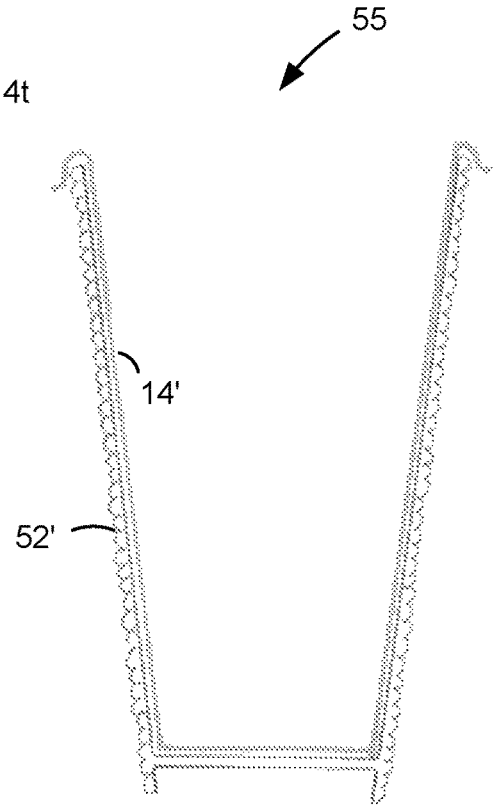
FIG. 2C is a cross-sectional side view of another example embodiment of a paper-based cup with a metallic layer in accordance with the teachings herein.
Figure 2B:
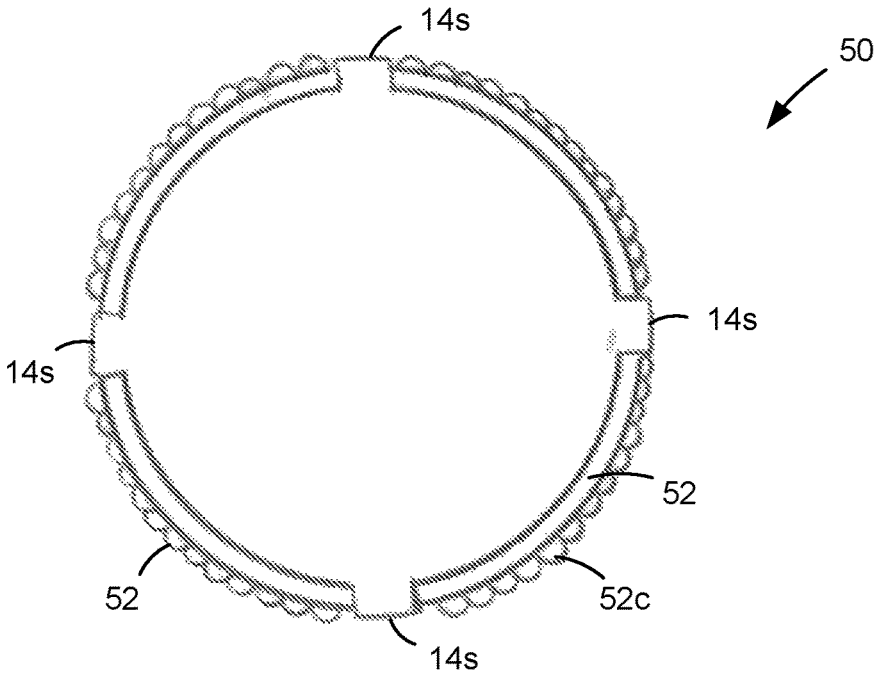
FIG. 2B is a top view of the paper-based cup of FIG. 2A.

Referring now to FIGS. 2A-2B, shown therein is a cross-sectional side view and a top view, respectively, of another example embodiment of a recyclable container 50, which is in the form or a paper-based cup with an inner metallic layer 14 in accordance with the teachings herein. The container 50 is similar to the container 10 in that the container comprises a frame 52 that has side walls 52*w*, a bottom wall 52*b*, an extension 52*e* and at least one rib 52*r*. Accordingly, the various features and alternative embodiments described for the container 10 are also applicable to the container 50. Furthermore, it should be noted that the lid of FIG. 1D may be used with the container 50.

However, one difference between the container 50 and the container 10 is that the frame 52 of the container 50 has a first layer with a relatively flat inner surface and a second outer layer 52*c* that is corrugated paper with horizontal ribs. In an alternative embodiment, the frame 52 may comprise a first layer that is paper-based with a relatively flat inner surface, a middle layer that is corrugated paper with horizontal ribs and an outer layer that is paper-based and has a relatively flat external surface. In yet another alternative embodiment, the frame 52 may only comprise a corrugated paper-based material.

Referring now to FIG. 2C, shown therein is a cross-sectional side view of another example embodiment of a paper-based container 55 (i.e. a cup) 55 with a metallic layer 14' in accordance with the teachings herein. This embodiment is similar to the container 15. Accordingly, the various features and alternative embodiments described for the container 15 are also applicable to the container 55. Furthermore, the lid of FIG. 1D may be used with the container 55.

However, one difference between the container 55 and the container 15 is that the frame 52' of the container 55 has a first layer with a relatively flat inner surface and a second outer layer 52' that is corrugated paper with horizontal ribs. In another embodiment, the frame 52' may comprise a first layer that is paper-based with a relatively flat inner surface, a middle layer that is corrugated paper with horizontal ribs and an outer layer that is paper-based with a relatively flat external surface. In yet another alternative embodiment, the frame 52' may only comprise a corrugated paper-based material.

Figure 3A:
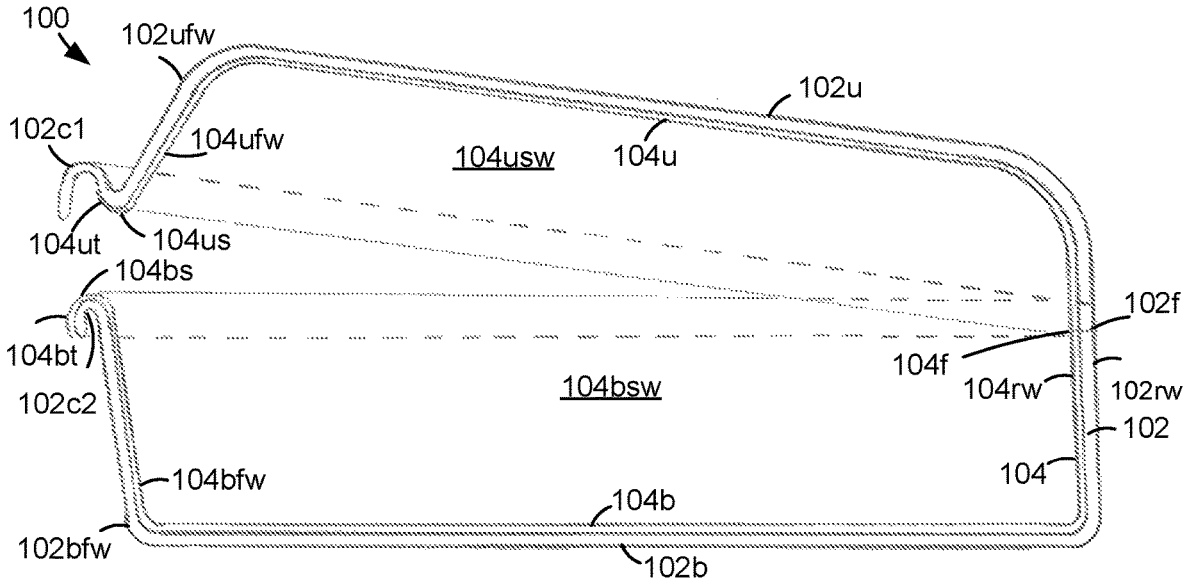
FIG. 3A is a cross-sectional side view of an example embodiment of a paper-based container with a metallic layer in accordance with the teachings herein.

Referring now to FIG. 3A, shown therein is a cross-sectional side view of an example embodiment of a paper-based take-out container 100 having a paper-based frame 102 and a metallic layer 104, in accordance with the teachings herein. The container 100 is structurally similar to the coffee cups and lids described previously. In particular, the metallic layer 104 is removably attachable to the paper-based frame 102 and may be held in place using various techniques such as one or more of a friction fit, tabs and a bonding agent. The paper-based frame 102 may be made using the various paper materials described herein. Likewise, the metallic layer 104 may be made using the various metallic materials described herein.

The frame 102 comprises front walls 102*ufw* and 102*bfw*, rear wall 102*rw*, bottom wall 102*b* and upper wall 102*u*. An upper portion of the upper front wall 102*ufw* extends to a first end of the upper wall 102*u* and a bottom portion of the lower front wall 102*bfw* extends to a first end of the bottom wall 104*b*. An upper portion of the rear wall 102*rw* extends to a second end of the upper wall 102*u* and a lower portion of the rear wall 102*rw* extends to a second end of the bottom wall 102*b*. There are also upper and lower sidewalls (not shown) that are orthogonal to the front and rear walls of the frame 102 to provide a complete enclosure for the frame 102.

The lower portion of the upper front wall 102*ufw* and the upper portion of the lower front wall 102*bfw* end in curled portions 102*c*1 and 102*c*2, respectively, which releasably engage one another to close the container 100. In particular, the upper surface of the curled portion 102*c*2 has a radius of curvature which is just smaller than the radius of curvature of the lower surface of the curled portion 102*c*1 so that the curled portion 102*c*2 makes a friction fit with the curled portion 102*c*1 to keep the container 100 in a closed position.

The metallic layer 104 comprises a complimentary shape to the frame 102. Accordingly, the metallic layer 104 comprises front walls 104*ufw* and 104*bfw*, rear wall 104*rw*, bottom wall 104*b* and upper wall 104*u*. An upper portion of the upper front wall 104*ufw* extends to a first end of the upper wall 104*u* and a bottom portion of the lower front wall 104*bfw* extends to a first end of the bottom wall 104*b*. An upper portion of the rear wall 104*rw* extends to a second end of the upper wall 104*u* and a lower portion of the rear wall 104*rw* extends to a second end of the bottom wall 104*b*. There are also upper and lower sidewalls 104*usw* and 104*bsw*, respectively, which are orthogonal to the front and rear walls of the metallic layer 104 to provide a complete enclosure for the metallic layer 104.

The lower portion of the upper front wall 104*ufw* and the upper portion of the lower front wall 104*bfw* have curved shoulder portions 104*us* and 102*bs*, respectively, which extend to tabs 104*ut* and 104*bt*, respectively. The tabs 104*ut* and 104*bt* each curl around the corresponding opposing portions of the frame 102 to hold the metallic layer 104 in place during use. During recycling, the tabs 104*ut* and 104*bt* can be pulled to remove the metallic layer 104 from the frame 102.

Figure 3B:
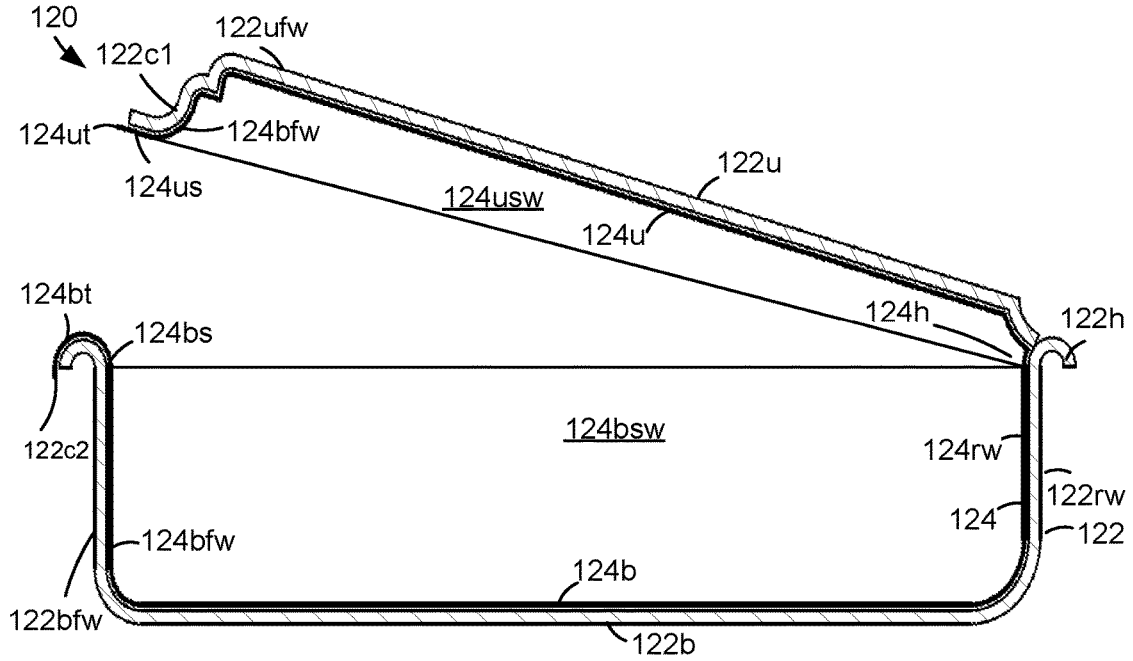
FIG. 3B is a cross-sectional side view of another example embodiment of a paper-based container with a metallic layer in accordance with the teachings herein.

Referring now to FIG. 3B, shown therein is a cross-sectional side view of another example embodiment of a paper-based take-out container 120 having a paper-based frame 122 and a metallic layer 124, in accordance with the teachings herein. The container 120 is also structurally similar to the coffee cups and lids described previously. In particular, the metallic layer 124 is removably attachable to the paper-based frame 122 using various techniques such as one or more of a friction fit, tabs and a bonding agent.

Furthermore, the container 120 is structurally similar to the container 100. The frame 122 of the container 120 comprises upper and lower front walls 122*ufw* and 122*bfw*, rear wall 122*rw*, bottom wall 122*b*, upper wall 122*u* and upper and lower sidewalls (not shown). The metallic layer 124 of the container 120 has a complimentary shape to the frame 122. The metallic layer 124 comprises upper and lower front walls 124*ufw* and 124*bfw*, rear wall 124*rw*, bottom wall 124*b*, upper wall 124*u* and upper and lower sidewalls 124*usw* and 124*bsw*. Furthermore, the metallic layer 124 has upper and lower tabs 124*ut* and 124*bt* as well as upper and lower shoulder portions 124*us* and 124*bs* that overlap and compress corresponding opposing portions 122*c*1 and 122*c*2 of the frame 122.

One difference between the container 120 and the container 100 is that the paper-based frame 122 employs a corrugated paper material with horizontal ribs. In this example embodiment the corrugated paper material of the paper-based frame 122 is between smooth layers of paper on the outer and inner surfaces of the corrugated paper material. In alternative embodiments, there may just be a smooth layer of paper on an inner surface of the corrugated paper material or there may just be a smooth layer of paper on an outer surface of the corrugated paper material.

Another difference between the container 120 and the container 100 is that the curled regions of the frame of the container 120 are structured slightly different than the corresponding regions of the container 100 and operate slightly differently. For example, the lower portion of the upper front wall 122*ufw* and the upper portion of the lower front wall 122*bfw* end in curled portions 122*c*1 and 122*c*2, respectively, which releasably engage one another to close the container 120. In particular, the upper surface of the curled portion 122*c*2 has a radius of curvature which is just smaller than the radius of curvature of the lower surface of an intermediate portion between the curled portion 122*c*1 and the bottom portion of the upper front wall 122*ufw* so that the curled portion 102*c*2 makes a friction fit with this intermediate portion to keep the container in a closed position.

Another difference between the container 120 and the container 100 is that the container 120 includes a hinged portion 122*h* in the paper-based frame 122 so that the lid of the container 120 can move more smoothly when the container 120 is opened and closed. The metallic layer 124 also includes a hinge portion 124*h* so that the metallic layer 124 can more easily accommodate the opening and closing of the container 120 without tearing. In contrast, the frame 102 and the metallic layer 104 include fold creases 102*f* and 104*f*, respectively, for accommodating the opening and closing of the container 100.

It should be noted that for both of the containers 100 and 120, although the example embodiments shown in FIGS. 3A and 3B do not show the frame 102 and the metallic layer 104 or the frame 122 and the metallic layer 124 having corresponding grooves and ribs, the containers 100 and 120 can be modified to include these elements in a similar fashion as was shown for the containers 10 and 50.

Figure 4A:
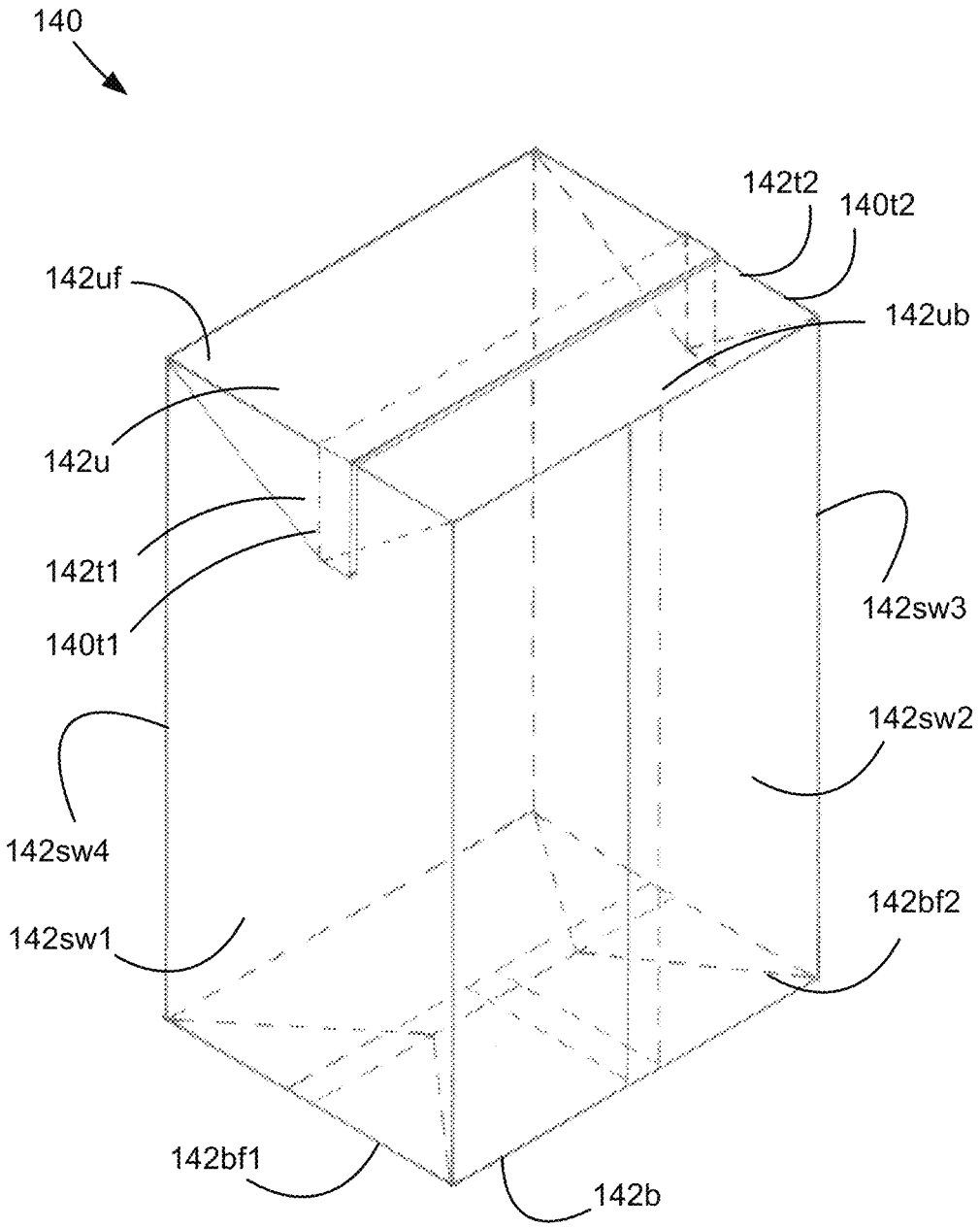
FIG. 4A is a perspective view of another example embodiment of a paper-based container with a metallic layer in accordance with the teachings herein.
Figure 4C:
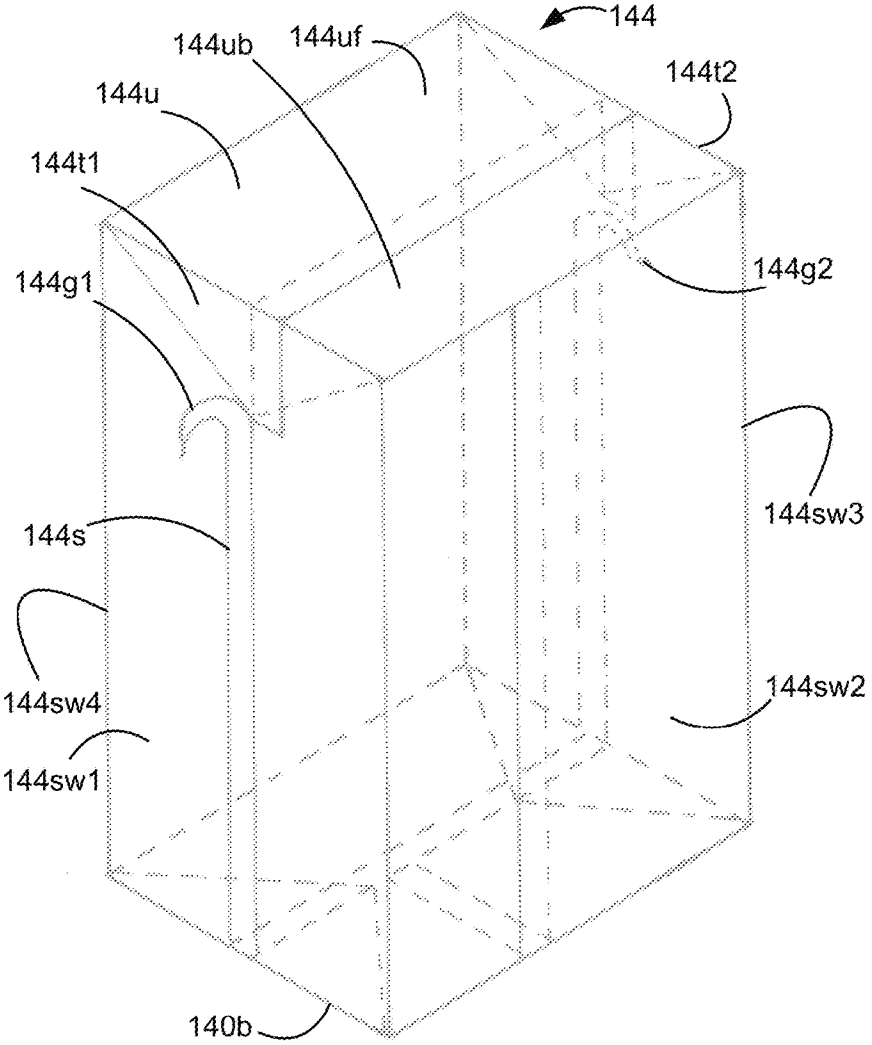
FIG. 4C is a perspective view of the metallic layer of the example embodiment of FIG. 4A.
Figure 4B:
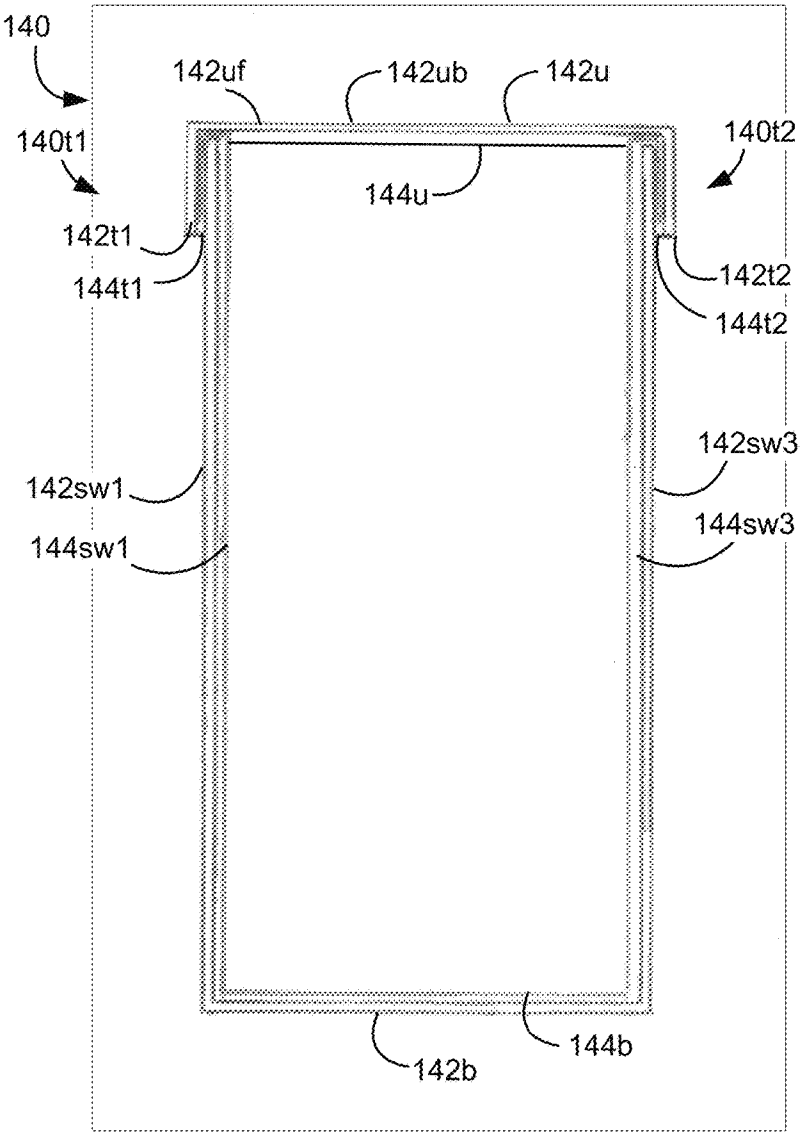
FIG. 4B is a cross-sectional side view of the example embodiment of FIG. 4A.

Referring now to FIGS. 4A and 4B, shown therein is a perspective view and a cross-sectional side view, respectively, of an example embodiment of a paper-based container 140. The container 140 has a paper-based frame 142 and a metallic layer 144, in accordance with the teachings herein. FIG. 4C shows a perspective view of the metallic layer 144 of the container 140. The container 140 is also structurally similar to the containers described previously. In particular, the metallic layer 144 is removably attachable to the paper-based frame 142 using various techniques such as one or more of a friction fit, tabs and a bonding agent.

In this example embodiment, the frame 142 comprises a bottom wall 142*b*, four side walls 1425*w*1, 142*sw*2, 142*sw*3 and 142*sw*4, and an upper wall 142*u*. The bottom wall 142*b* is formed by an extension of side walls 142*sw*2 and 142*sw*4. The bottom wall 142*b* has two folded portions 142*bf*1 and 142*bf*2 that extend from side walls 1425*w*1 and 142*sw*3 to overlap the bottom wall 142*b*. Upper wall 142*u* has a base portion 142*ub* and a folded portion 142*uf*. The folded portion 142*uf* extends from the side wall 142*sw*4 and overlaps the base portion 142*ub*. The folded portion 142*uf* extends over the edge of the upper wall base portion 142*ub* to overlap the side walls 1425*w*1 and 142*sw*3, forming two tabs, 142*t*1 and 142*t*2.

The metallic layer 144 of the container 140 has a complimentary shape to the paper-based frame 142. The metallic layer 144 comprises a bottom wall 144*b*, an upper wall 144*u*, four side walls 1445*w*1, 144*sw*2, 144*sw*3 and 144*sw*4. The upper wall 144*u* has a base portion 144*ub* and a folded portion 144*uf*. The folded portion 144*uf* extends over the edge of the upper wall 144*u* to overlap the side walls 1445*w*1 and 142*sw*3, forming two tabs 144*t*2 and 144*t*2. The bottom wall 144*b* is flat to correspond to the inner surface of the bottom wall 142*b*. The metallic layer 144 also has at least one strip 144*s* that extends from the side wall 1445*w*1 to the side wall 144*sw*3 (not visible in FIG. 4A and not shown in FIG. 4B). The strip 144*s* may extend past the edge of the side wall 1445*w*1 and the side wall 144*sw*3 to have a first grip portion 144*g*1 and a second grip portion 144*g*2. The strip 144*s* may be an appropriate width for allowing the metallic layer 144 to be pulled from the paper-based frame 142. For example, the strip 144*s* may be, but is not limited to being, 0.5 inches wide in some cases. In some embodiments, there may be at least one grip portion.

To open the container 140, the first tab 140*t*1 comprising 142*t*1 and 144*t*2 is pulled away from the sidewall 1425*w*1. The pulled first tab 140*t*1 may have a portion removed, creating an opening in the container 140. This opening process may also be used with the second tab 140*t*2, or both tabs 140*t*1 and 140*t*2.

For recycling, one or both of the grip portions 144*g*1 and 144*g*2 may be pulled. The grip portions 144*g*1 and 144*g*2 are attached to the strip 144*s*1, which is attached to the metallic layer 144. By pulling the grip portions 144*g*1 or 144*g*2, the metallic layer 144 may be pulled out of the opening that has been made by removing a portion of the container 140, thereby separating the metallic layer 144 from the paper-based frame 142.

In some embodiments, the strip 144*s* is a part of the side walls 1445*w*1 and 144*sw*3. In some embodiments, the strip 144*s* is a separate piece of metal that is fixed to the metallic layer 144.

In some embodiments, the strip 144*s* may not be visible until the tab 142*t*1 or 142*t*2 is lifted, showing the grip portions 144*g*1 or 144*g*2 underneath. For example, in FIG. 4A the strip 144*s* is not visible.

In some embodiments, there may not be a strip 144*s*. In such an embodiment, for recycling, the upper walls 142*u* and 144*u* may be ripped or cut open, and the frame 142 may be separated from the metallic layer 144. In some embodiments, there may be a paper tab across the top or side of the container to easily rip the container open.

Figure 5B:
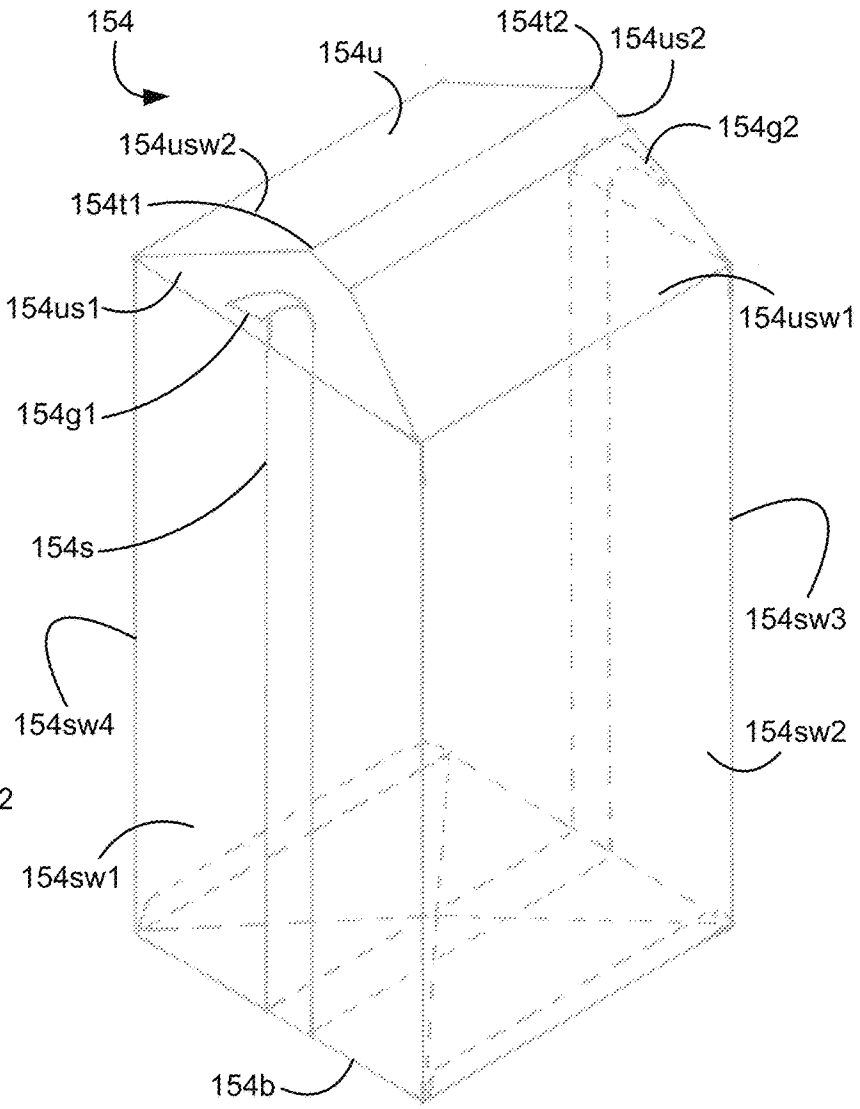
FIG. 5B is a perspective view of the metallic layer of the example embodiment of FIG. 5A.
Figure 5A:
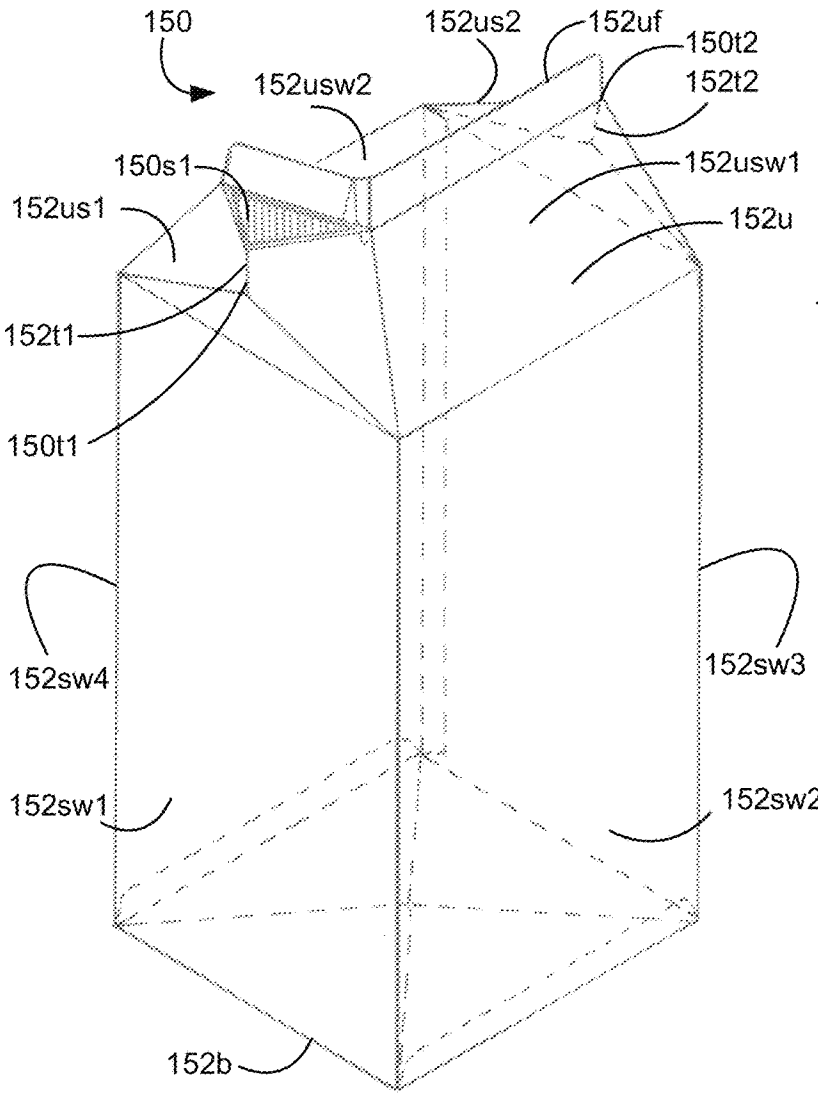
FIG. 5A a perspective view of another example embodiment of a paper-based container with a metallic layer in accordance with the teachings herein.

Referring now to FIG. 5A, shown therein is a perspective view of an example embodiment of a paper-based container 150 having a paper-based frame 152 and a metallic layer 154 in accordance with the teachings herein. FIG. 5B shows a perspective view of the metallic layer 154 of the container 150. The container 150 is also structurally similar to the containers described previously. In particular, the metallic layer 154 is removably attachable to the paper-based frame 152 using various techniques such as one or more of a friction fit, tabs and a bonding agent.

In this example embodiment, the frame 152 comprises a bottom wall 152*b*, four side walls 1525*w*1, 152*sw*2, 152*sw*3 and 152*sw*4, and an upper wall 152*u*. The bottom wall 152*b* is formed by joining extensions of side walls 1525*w*1, 152*sw*2, 152*sw*3 and 152*sw*4. The upper wall 152*u* has a first upper side wall 152*usw*1 and a second upper side wall 152*usw*2. The upper wall 152*u* also has a first spout portion 152*us*1 with a first tab 152*t*1 and a second spout portion 152*us*2 with a second tab 152*t*2. The upper side walls 152*usw*1 and 152*usw*2 extend past a height of the spout portions 152*us*1 and 152*us*2 to form a flat portion 152*uf*.

The metallic layer 154 of the container 150 has a complimentary shape to the paper-based frame 152. The metallic layer 154 comprises a bottom wall 154*b*, four side walls 1545*w*1, 154*sw*2, 154*sw*3 and 154*sw*4, and an upper wall 154*u*. The upper wall 154*u* has a first upper side wall 154*usw*1 and a second upper side wall 154*usw*2. The upper wall 154*u* also has a first spout portion 154*us*1 with a first tab portion 154*t*1 and a second spout portion 154*us*2 with a second tab portion 154*t*2. Together, the tab portions 152*t*1 and 154*t*1 form a first tab 150*t*1. Similarly, the tab portions 152*t*2 and 154*t*2 form a second tab portion 150*t*2. The metallic layer 154 also has a strip 154*s* that extends from the side wall 1545*w*1 to the side wall 154*sw*3 (not visible in FIG. 5A). The strip 154*s* may extend past the edge of the side wall 1545*w*1 and the side wall 154*sw*3 to form a first grip portion 154*g*1 and a second grip portion 154*g*2. In some embodiments, there may be at least one grip portion.

The container 150 shown in FIG. 5A is in an opened position. To open the container 150 from a closed position, the first tab 150*t*1 may be pulled away from container 150. Pulling tab 150*t*1 creates an opening in the container 150, also known as a first spout 150*s*1. The container 150 may also be opened by pulling the second tab 150*t*2, or by pulling both the first tab 150*t*1 and the second tab 150*t*2.

For recycling, one or both of the grip portions 154*g*1 and 154*g*2 may be pulled. The grip portions 154*g*1 and 154*g*2 are attached to the strip 154*s*1, which is attached to the metallic layer 154. By pulling the grip portions 154*g*1 or 154*g*2, the metallic layer 154 may be pulled out of the opening that has been cut into the container 150, thereby separating the metallic layer 154 from the paper-based frame 152.

In some embodiments, the strip 154*s* is a part of the side walls 1545*w*1 and 154*sw*3. In some embodiments, the strip 154*s* is a separate piece of metal that is fixed to the metallic layer 154.

In some embodiments, the strip 154*s* may not be visible until the tab 152*t*1 or 152*t*2 is lifted, showing the grip portions 154*g*1 or 154*g*2. For example, in FIG. 4A the strip 154*s* is not visible.

In some embodiments, pulling the strip 154*s* may cause the frame to tear, thereby making it easier to separate the metallic layer from the frame.

In some embodiments, there may not be a strip 154*s*. In such an embodiment, for recycling, the upper walls may be ripped or cut open, and the frame may be separated from the metallic layer. In some embodiments, there may be a paper tab across the top or side of the container to more easily rip the container open.

It should be noted that the various cups and the containers of FIGS. 3A and 3B described herein may be made with rounded paper bottom edges so that packaging these product remains the same in terms of stacking each item on top of one another in a traditional tubular form. In addition, the bottom of the lids and the top of the cups and containers of FIGS. 3A and 3B may have rounded paper edges over which the tab portions of the metallic layer will overlap. The advantage of these rounded top and bottom edges is to prevent friction or tearing of the inner metallic layer during the manufacturing and packaging phases.

For the embodiments of all of the containers described herein with corrugated paper, i.e. containers 50, 55 and 120, vertical ribs may be used instead of horizontal ribs for the corrugated paper. Alternatively, in such embodiments, angled ribs may be used for the corrugated paper. In yet another alternative, a combination of at least two of horizontal, vertical and angled ribs may be used for the corrugated paper. Also, in some alternative embodiments, the containers 140 and 150 may also employ vertical or horizontal ribs to maintain the inner metallic layer in friction fit with the paper-based frame.

For the various embodiments described herein, the various containers may have different dimensions, i.e. different heights, widths, circumferences, and thicknesses, depending on the particular use of the container.

In addition, for the various embodiments described herein, the thickness of the paper-based frame may be selected such that it is on average between about 28 to 36 calipers depending on the usage of the container. For example, containers that will have heavier contents can have a thicker paper-based frame such as a thickness of 36 calipers. In alternative embodiments of the cups described herein, the thickness of the cup may initially start at about 30 to 32 calipers at an upper portion and gradually get thicker towards the bottom of the cup.

In addition, for the various embodiments described herein, the thickness of the metallic layer may be selected to be in a range of about 0.016 mm to 0.036 mm. Alternatively, for containers that will carry heavier contents the thickness of the metallic layer may be at least 0.036 mm and increases as the shape/size of the container increases or the amount/weight of the content that is intended to be carried by the container increases.

Furthermore, in the various embodiments described herein, the metallic layers may be made with a material that provides a sufficient structural rigidity to the metallic layer so that it does not lose its shape or tear during use.

Figure 6:
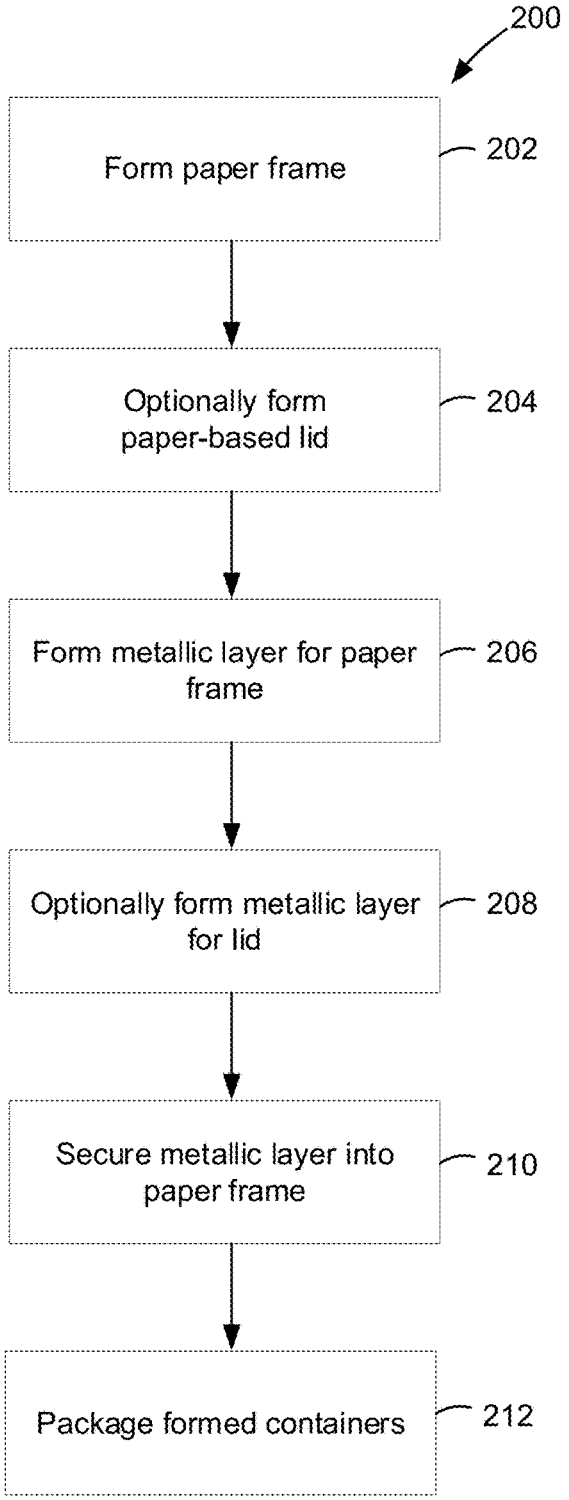
FIG. 6 is a flowchart of an example embodiment of a method for manufacturing paper-based cups, lids and containers having a metallic layer described in accordance with the teachings herein.

Referring now to FIG. 6, shown therein is a flowchart of an example embodiment of a method 200 for manufacturing containers that are paper-based and have an inner metallic layer, such as the containers described herein. The containers may be cups, bowls, take-out containers with an integral or separate lid and cartons as described herein.

At act 202 of the manufacturing method 200, the paper frame is formed for the container. A machine can be selected for forming the container based on the type of container to be formed, i.e. a cup, a bowl, a take-out container, carton, and the like. The container is formed according to the design and one of the paper-based materials described herein which may comprise one or more smooth layers, at least one smooth layer and a corrugated layer or a corrugated layer in between two smooth layers. Again, depending on the design the smooth layer that faces the inside of the container may be flat or may comprise at least one groove or rib in accordance with the teachings herein. Alternatively, the at least one groove or rib may be formed by the manufacturing machine. Furthermore, for a single-piece take-out container, a portion of the paper-based material is shaped to form the curled portions and a hinge portion for opening and closing the container. Alternatively, for a carton-shaped container, the paper-based material is shaped to form the foldable portions.

Still at act 202, a large roll of the paper based material, which may or may not have any print or patterns on the surface that will form the outside of the container, is fed into the manufacturing machine through a cutting stage where it is cut into paper pieces (i.e. blanks) according to the shape of the container. There may be a stamping stage if at least one rib or groove need or curls need to be formed on the paper pieces. The paper pieces may then be sent through a heat stage to be warmed up and then to a folding stage where the paper pieces are folded to form the various walls of the container. After the folding stage the folded paper pieces may be sent to an assembly stage where they are attached to one another to form the container if several different pieces are needed to form the container. Alternatively, if the container is made of a single piece of paper, the folds may be sealed together at the assembly stage. After the folding stage, there may be a curling stage if certain portions of the container need to be curled, such as when a cup is being formed that has a lip at the opening. After the curling stage, there may be a blow-out stage to remove any debris that should not be part of the container.

At act 204 the lid can be formed for the paper frames when the containers require a lid. While the embodiments with the lids were shown with respect to cups, it should be understood that this can be extended to cases where the containers are bowls or take-out containers where the lid is a separate piece. This is optional depending on the type of container that is being made. Act 204 is somewhat similar to act 202 in that a large roll of the paper based material, which may or may not have any print or patterns on the surface that will form the upper surface of the lid, is fed into a lid manufacturing machine where it is passed through a cutting stage where the paper is cut into paper pieces (i.e. blanks) according to the shape of the lid. The paper pieces may then be sent through a heat stage to be warmed up and then to a stamping stage form the various curves and grooves in the lid as well as punch through holes through which the contents of the cup that the lid is used with may be drunk by a user. After the folding stage, there may be a blow-out stage to remove any debris that should not be part of the lid.

At act 206, the metallic layer for the paper-based frame is formed. The same general processing may be used here as was used for act 202 where the paper-based frame was used. However, the metallic layer may be formed slightly differently in that the metallic layer pieces that are made may also include at least one tab depending on the embodiment of the container that is being manufactured. Alternatively, the tabs may be made from another material and attached to the metallic layer pieces. The metallic layer pieces be formed to fit with the inside of the paper frame by using a mold in a folding process, or the metallic layer may have certain sections that are cut and the folded to confirm with the shape of the metallic frame.

At act 208, the metallic layer for the paper-based body of the lid is formed. Again this act is optional when a lid is not needed for the container. Act 208 is somewhat similar to act 204 where the metallic layer generally has the same shape as the paper body used for the lid and can therefore be formed in a similar fashion. However, the metallic layer for the lid may have tab portions that are either integral with the metallic layer or attached after the metallic layer is formed.

At act 210, another machine may be used to insert the metallic layer, which was formed during act 206, into place within the paper-based frame that was made during act 202. Depending on the particular embodiment, act 206 may involve only using a fiction fit between the metallic layer and the paper frame to keep the metallic frame in place. Alternatively, at least one of tabs and a bonding agent may also be used to keep the metallic frame in place. This may be repeated for the embodiments in which paper-based lids and metallic layers for the lids are made.

At act 212, the formed containers are then packaged in a stack of containers by placing them within one another. In cases where the lids are formed, the containers may be stacked independently in one package and the lids may be stacked in another package.

Figure 7:
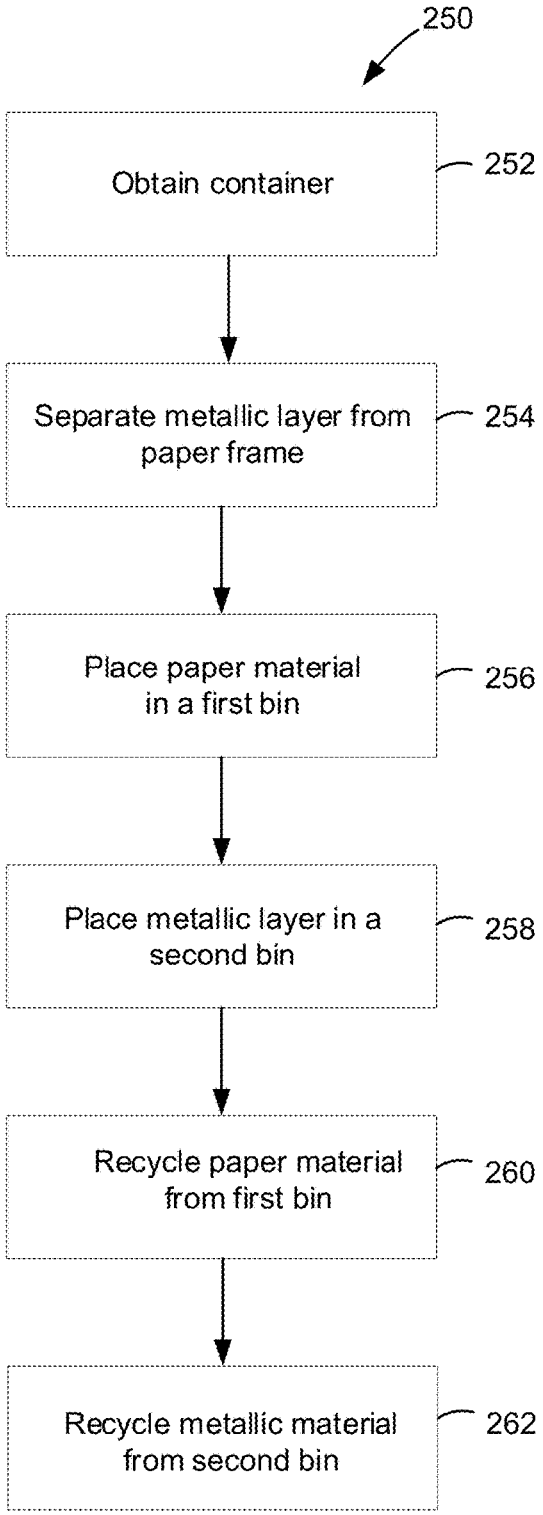
FIG. 7 is a flowchart of an example embodiment of a method for recycling paper-based cups, lids and containers having a metallic layer described in accordance with the teachings herein.

Referring now to FIG. 7 is a flowchart of an example embodiment of a method 250 for recycling containers that are paper-based and have an inner metallic layer, such as the containers described herein. The containers may be cups, bowls, take-out containers with an integral or separate lid and cartons as described herein.

At act 252, each container is obtained from a source such as a bin and fed into a separation stage.

At act 254, the separation stage separates the metallic layer from the paper-based frame. In embodiments which use the tabs, the separation stage may engage the tabs to pull the metallic layer from the paper-based frame. When bonding agents are used, the separation stage may also including a heating element for heating the container to break down the bonding agent to facilitate this separation process.

In another alternative, at act 254, the obtained container may be then be placed in a bath which includes liquid that is absorbed by the paper frame and makes the paper frame heavier such that the paper material will sink to the bottom of the bath and the metallic layer may float along the top of the bath. For example, the liquid bath may be soap and water that may act to loosen the bonding agent, to loosen the metallic layer from being coupled to the paper-based frame, and to clean the metallic and paper materials. The metallic layers may then be separated be collected from the top of the bath and the paper-based materials may then be collected from the bottom of the bath. The bath may also be heated to help breakdown any bonding agents that may be used in the containers.

At act 256, the collected paper material is placed within a first bin and at act 258, the collected metallic layer is placed in a second bin. There may be monetary compensation for the collected materials.

At act 260, the paper material may be recycled. This can be done using various techniques such as soaking the paper material so that it becomes pulp. The pulp can then be filtered to remove any non-paper materials such as any bonding agents that remain or ink. The filtered pulp can then be processed to become paper again.

In an alternative embodiment, in the case of recycling the fibrous material, this collected paper-based material can be also be compressed to make bio-fuel, which may be done using various techniques such as a Swedish based technology, for example as shown at the website: https://en.wikipedia.org/wiki/Biofuel_in_Sweden. In the case of collected fibrous material, this material can be fully used in the manufacturing of new paper material for the cups, lids and containers described herein or for other paper-based containers.

At act 262, the collected metallic material may be recycled using various techniques. For example, contaminants may be removed from the metallic material. The metallic material may be heated to form a liquid metal that may then be used to form other products, such as metallic layers for other containers.

Alternatively, for embodiments which use tabs, the separation of the metallic layer from the paper-based frames can start at the user level where the user may loosen the tabs (this may be achieved with more public knowledge through advertisements of how to recycle these containers). These containers can then be sent to the recycling plant where the containers are placed in hot pools to separate the paper-based materials from the metallic materials.

It should be noted that the above recycling techniques can be similarly applied to paper-based lids with metallic layers.

It is believed that the embodiments described herein may act as a catalyst to provide the public with knowledge in the way each person can assist in the recycling process. The manufacturing and recycling techniques can provide one-time use cups and containers that can be more fully recycled than currently used containers and recycling techniques.

While the applicant's teachings described herein are in conjunction with various embodiments for illustrative purposes, it is not intended that the applicant's teachings be limited to such embodiments as the embodiments described herein are intended to be examples. On the contrary, the applicant's teachings described and illustrated herein encompass various alternatives, modifications, and equivalents, without departing from the embodiments described herein, the general scope of which is defined in the appended claims

The invention claimed is:

1. A recyclable container comprising:

a frame made of a first paper-based material, the frame having a bottom wall and at least one side wall that extends from the bottom wall and has an upper lip and an outermost surface; and a metallic layer that is removably positioned along an inner surface of the bottom and side walls of the frame; and at least one tab that is attached to a portion of the metallic layer, the at least one tab having a portion that is adapted to extend past an opening of the container and overlap the upper lip of the at least one side wall of the container along a limited section of an upper surface of the at least one side wall and overlap the outermost surface of the at least one side wall to removably secure the metallic layer to the frame, wherein the at least one tab is pullable to remove the metallic layer from the frame.

2. The container of claim 1, wherein the frame and the metallic layer each have an upper wall extending to each side wall.

3. The container of claim 2, wherein an opening is formed by pulling the at least one tab or an opening is formed by pulling the at least one tab and removing an end portion of the at least one tab.

4. The container of claim 2, wherein the metallic layer includes a strip with at least one grip portion and the at least one grip is pulled to remove the metallic layer from the paper-based frame.

5. The container of claim 1, wherein the container comprises a lid having:

a body made of a second paper-based material;

a second metallic layer on an inner surface of the body; and at least one groove that is sized and shaped to mate with an upper edge of at least one side wall at an opening of the frame.

6. The container of claim 5, wherein the container is a cup, a bowl, or a take-out container and the lid is integral with or separate from the frame of the container.

7. The container of claim 1, wherein the metallic layer has an outer surface that is sized to provide a friction fit when the metallic layer is disposed within the frame to maintain the metallic layer in place during use.

8. The container of claim 1, wherein the metallic layer comprises at least one rib on an outer surface thereof and the frame comprises at least one groove on an inner surface thereof, the at least one rib and the at least one groove being located and sized to removably engage one another when the metallic layer is disposed within the frame to maintain the metallic layer in place during use.

9. The container of claim 1, wherein the metallic layer comprises at least one groove on an outer surface thereof and the frame comprises at least one rib on an inner surface thereof, the at least one groove and the at least one rib being located and sized to removably engage one another when the metallic layer is disposed within the frame to maintain the metallic layer in place during use.

10. The container of claim 1, wherein a bonding agent is applied to one or more corresponding portions of the outer surface of the metallic layer and the inner surface of the frame to hold the metallic layer in place during use, wherein the bonding agent is temporary and is removable during recycling.

11. The container of claim 10, wherein the bonding agent comprises a natural glue.

12. The container of claim 5, wherein the frame and/or the lid comprises at least one layer of paper.

13. The container of claim 12, wherein the frame comprises an outer layer that is corrugated paper with horizontal and/or vertical ribs.

14. The container of claim 12, wherein the frame comprises a middle layer that is corrugated paper with horizontal and/or vertical ribs and an outer paper layer with a relatively flat external surface.

15. The container of claim 5, wherein the first and second paper-based materials comprise at least one of recycled paper, fibrous pulp and a fibrous material blend.

16. The container of claim 1, wherein the metallic layer comprises at least one of aluminum foil, aluminum alloy, anodized aluminum, nickel and tin.

17. A method of making a container having an inner metallic layer, wherein the method comprises:

forming a paper-based frame having a desired shape with at least one side wall, the at least one side wall having an upper lip and an outermost surface;

forming a first metallic layer being sized to provide an inner lining for the paper-based frame;

providing at least one tab adjacent to an outer edge of the first metallic layer, the at least one tab having an outer portion; and releasably coupling the first metallic layer to an inner surface of the paper-based frame such that the outer portion of the at least one tab covers a limited section of the upper lip of the at least one side wall and overlaps the outermost surface of the at least one side wall.

18. The method of claim 17, wherein the first metallic layer has a complementary shape as the paper-based frame to provide a friction fit when placed within the paper-based frame.

19. The method of claim 18, wherein the outer portion of the at least one tab is wrapped to a portion of the paper-based frame to releasably couple the first metallic layer to the paper-based frame.

20. The method of claim 17, wherein the method further comprises:

forming a lid with a paper-based body;

forming a second metallic layer sized to provide an inner lining for the paper-based body of the lid; and releasably coupling the second metallic layer to a surface of the lid that faces towards an opening of the container when the lid is placed on the frame of the container.

21. The method of claim 20, wherein the method further comprises providing at least one additional tab adjacent to an outer edge of the second metallic layer; and wrapping an outer portion of the at least one additional tab to a portion of the paper-based body of the lid to couple the second metallic layer to the paper-based body.

22. A recyclable container comprising:

a frame made of a first paper-based material, the frame having a bottom wall and at least one side wall that extends from the bottom wall and has an upper lip; and a metallic layer that is removably positioned along an inner surface of the bottom and side walls of the frame; and at least one tab that is attached to a portion of the metallic layer, the at least one tab having a portion that is adapted to extend past an opening of the container and overlap the upper lip of the at least one side wall of the container along a section of an upper surface of the at least one side wall to removably secure the metallic layer to the frame, wherein:

the at least one tab is pullable to remove the metallic layer from the frame, and one of the metallic layer or frame comprises at least one rib on a surface thereof and the other of the metallic layer or frame comprises at least one groove on a surface thereof, the at least one rib and the at least one groove being located and sized to removably engage one another when the metallic layer is disposed within the frame to maintain the metallic layer in place during use.

23. The container of claim 1, wherein the metallic layer is made of a material that is of a sufficient structural rigidity that the metallic layer does not lose shape or tear during use.

* * * * *